United States Patent [19]

Correll

[11] Patent Number: 4,580,988

[45] Date of Patent: Apr. 8, 1986

[54] FLOATATION DEVICE ADAPTED FOR PHYSICAL THERAPY AND RECREATION

[76] Inventor: Charles Correll, 161 Haigler Rd., Lenoir, N.C. 28645

[21] Appl. No.: 566,685

[22] Filed: Dec. 29, 1983

[51] Int. Cl.[4] ..... A63C 15/00

[52] U.S. Cl. ..... 441/130; 114/123

[58] Field of Search ..... 434/262, 254; 441/129–132, 136, 80, 88, 65, 35, 1, 127; 114/123, 90, 61, 292, 52, 53, 77 R

[56] References Cited

U.S. PATENT DOCUMENTS

| | | | |
|---|---|---|---|
| 8,164 | 6/1851 | Brown | 114/90 |
| 1,829,090 | 10/1931 | Harris | 441/130 |
| 2,013,410 | 9/1935 | Howland | 441/130 |
| 2,946,068 | 7/1960 | Jasper | 441/130 |
| 2,974,331 | 3/1961 | Dize | 441/130 |
| 3,323,151 | 6/1967 | Lerman | 441/127 X |
| 4,379,704 | 4/1983 | Rademacher | 441/88 |
| 4,443,204 | 4/1984 | Perrin | 441/129 |

FOREIGN PATENT DOCUMENTS

| | | | |
|---|---|---|---|
| 1324618 | 3/1963 | France | 441/1 |
| 518334 | 3/1955 | Italy | 441/132 |
| 416662 | 9/1934 | United Kingdom | 441/130 |

*Primary Examiner*—Sherman D. Basinger

*Attorney, Agent, or Firm*—W. Thad Adams, III

[57] ABSTRACT

A float (10) is disclosed for providing vertical, side-to-side and front-to-back support to a user. Float (10) includes a seat (11) for supporting the user in a pre-determined astride, sidesaddle or reclined position. First and second buoyant elongate body supports (20 and 21) are each secured by a hinge to opposite ends of seat (11). The body supports (20 and 21) support opposite sides of the torso of the user depending upon the manner in which the user sits on the seat. The body supports (20 and 21) are freely and independently moveable about their respective hinges (12 and 13) within a relatively wide angle of travel to permit adjustment to varying body positions and movements. According to one embodiment of the invention, auxiliary stabilizing floats (33, 34 and 39, 40) are telescoped within bores (30 and 31) of the body supports (20' and 21'). By extending the auxiliary floats (33, 34 and 39, 40) greater resistance to side-to-side or front-to-back tipping is provided.

6 Claims, 8 Drawing Figures

FIG. 2
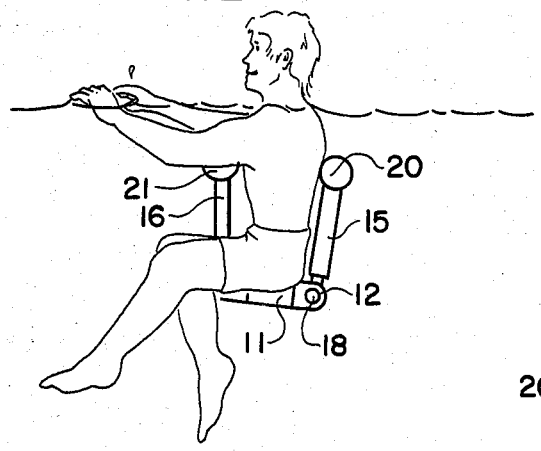
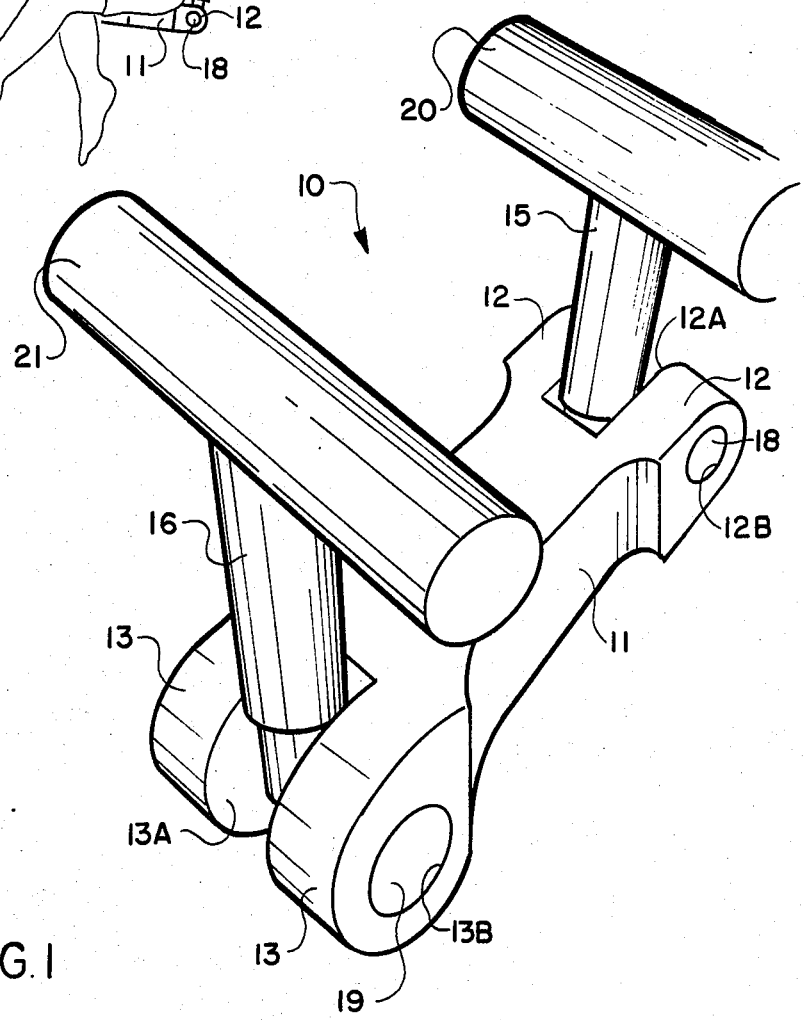
FIG. 1

FLOATATION DEVICE ADAPTED FOR PHYSICAL THERAPY AND RECREATION

TECHNICAL FIELD AND BACKGROUND OF THE INVENTION

This invention relates to a floatation device having features which make it particularly useful as a physical therapy tool, and also for recreation. Three variations of the same generic floatation device are disclosed, each of which has particular and unique features.

All three variations take unique advantage of the fact that the human body is composed primarily of water and therefore has a specific gravity which approximates that of water. Therefore, a relatively small amount of additional buoyancy enables the human body to float very easily in water with little or no necessary use of the arms or legs.

Because of the natural buoyancy of the human body, water is a very desirable medium within which to conduct physical therapy with invalids or individuals recovering from injuries. The natural buoyancy permits the arms and legs to engage in very light exercise as the physical therapy program begins. As the body muscles regain their tone the vigor of the exercise can be gradually increased, all without regard to the weight of the body or other infirmaties which may subsist and make the use of other body members undesirable or impossible.

To the best of applicant's knowledge, the prior art does not disclose a device which recognizes and addresses all of the factors which are particularly important when the floatation device is being used to conduct physical therapy. Most importantly, such a device must permit free and unimpeded movement of the arms and legs. Such movement should be possible without any unnecessary rubbing or chaffing by the arms or legs against the device.

The device should also provide suitable buoyancy and, at the same time, be sufficiently stable so as to prevent tipping. This is particularly important when used by those recovering from accidents since the user's sense of balance may not be fully functional.

The device should also be simple and safe to mount and dismount in a variety of ways and without danger of having an arm or leg trapped and held under water by a part of the device.

The device should also be lightweight, inexpensive and easily adaptable to a wide range of weights.

Preferably, the device should be capable of holding the user's head, neck and shoulders well above the water without obstructing movement of the arms and legs.

The device should also be designed to permit the user's body to be suspended at the proper level above the surface of the water while the floatation device itself is suspended beneath the water and should be adjustable to accomplish this purpose.

Finally, the device should also be suitable for use as a purely recreational product.

It has been determined that these goals can be best achieved by using a structure which is conformable to a variety of positions and which has a floatation structure which is relatively wide in comparison with the width of the body in order to provide protection against the loss of balance by the user carrying the center of gravity beyond the outer extent of the floats.

Therefore, it is an object of the invention to provide a floatation device for providing vertical, side-to-side and front-to-back support to a user, such as handicapped or invalid users, as well as for recreational purposes.

It is another object of the present invention to provide a floatation device which permits free movement of the arms and legs of the user and which is simple and safe to mount and dismount.

It is another object of the present invention to provide a floatation device which is sufficiently wide to prevent tipping.

It is another object of the present invention to provide a floatation device which is adjustable to a wide range of weights and which will provide buoyancy to the body while the floatation device itself is under the surface of the water.

These and other objects and advantages of the present invention are achieved in the preferred embodiments of the floatation devices below by providing a seat for supporting the user in a pre-determined astride, sidesaddle or reclined position. First and second buoyant, elongate body supports are secured by hinges to opposite ends of the seat. The first and second body supports are freely and independently movable about their respective hinges within a relatively wide angle of travel to permit adjustment to varying body positions and movements while maintaining the user in the predetermined position on the seat and permitting the free use of arms and legs by the user.

According to one embodiment of the invention, auxiliary stabilizing means are carried on the first and second body supports and are selectively moveable between a retracted position within the body support and an extended position outboard of the body support to provide greater leverage against side-to-side or front-to-back tipping.

According to another embodiment of the invention, the floatation device comprises a seat for supporting the user in a pre-determined astride, side-to-side, or reclined position. First and second elongate arms are secured, respectively, by one end thereof to opposite ends of the seat. The first and second arms extend outwardly from the seat and are secured by hinges to the seat and are thereby independently moveable to permit adjustment to varying body positions and movements of the user. First and second floatation members are secured, respectively, to the free, outwardly extending ends of the first and second arms. One of the first and second floatation members is adapted to support the front of the torso of the user in the astride position, one side of the torso in the sidesaddle position, or the legs in the reclined position. The other of the first and second floatation members is adapted to support the rear of the torso of the user in the astride and reclined positions, or the other side of the torso in the sidesaddle position. The first and second floatation members are attached, respectively, to the arms at substantially right angles thereto to collectively define a pair of "T" shaped members which provide stability in the water and permit free use of the arms and legs by the user.

According to another embodiment of the invention, a seat is provided for supporting the user in a pre-determined astride, sidesaddle or reclined position. The seat comprises an hourglass-shaped, relatively thin pad having a narrow central portion adapted to pass between the legs of the user and two opposing, relatively wide end portions. First and second floatation members are flexibly secured, respectively, to the relatively wide end portions of the seat and are adapted for extending upwardly into body-supporting contact on opposite sides of the user's torso for free and independent movement in response to movement by the user.

Semiflexible resilient means are secured to and cooperate with the seat to bias the seat in a relatively planar condition when not being sat upon. The semiflexible resilient means permit flexure of the seat when the user is seated thereon in response to the upward urging of the first and second floatation members. If the user falls off the seat, the resilient means will restore the seat to its relatively planar condition so that the first and second floatation members will not wrap the user's foot therebetween.

BRIEF DESCRIPTION OF THE DRAWINGS

Some of the objects of the invention have been set forth above. Other objects and advantages of the invention will appear as the description of the invention proceeds, when taken in conjunction with the following drawings, in which:

FIG. 1 is a perspective view of one of the embodiments of the floatation device;

FIG. 2 is a side view of one of the embodiments shown in FIG. 1 while in use;

DESCRIPTION OF THE PREFERRED EMBODIMENT

Figure 3:
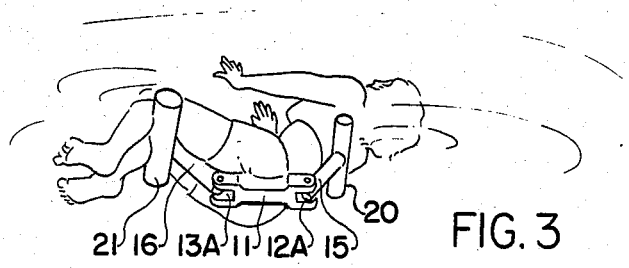
FIG. 3 is a view, from underneath, of the floatation device in FIG. 2, while in use in the reclining position.

Referring now specifically to the drawings, a floatation device according to one embodiment of the invention is shown in FIG. 1 and broadly indicated at broad reference numeral 10. Floatation device 10 is comprised of a seat 11, which is preferably constructed of wood or a lightweight, buoyant plastic material. Seat 11 is narrow in its central portion and defines enlarged hinged portions 12 and 13, respectively, on opposite ends thereof. Channels 12*a* and 13*a* are formed in hinges 12 and 13, respectively, and communicate at substantially right angles with axle bores 12*b* and 13*b*, also formed in hinges 12 and 13, respectively. Elongate arms 15 and 16 are positioned by one end thereof in channels 12*a* and 13*a*, respectively. A hinge axle 18 is positioned in axle bore 12*b* and extends completely through hinge 12 from one side to the other, and also through a suitably sized bore (not shown) in one end of arm 15. Likewise, a hinged axle 19 is positioned in and extends from one side to the other of axle bore 13*b* and also through one end of elongate arm 16. Arms 15 and 16 are therefore hinged to opposite ends of seat 11 and are freely and independently movable about their respective hinges. Arms 15 and 16 are preferably constructed of a lightweight, buoyant material such as PVC pipe and may, if necessary, be filled with styrofoam or some other lightweight, buoyant substance.

Elongate body supports, comprising floatation members 20 and 21 are secured at right angles to the upper, free end of elongate arms 15 and 16, respectively. As is shown in FIG. 1, arms 15 and 16 and their respective floatation members 20 and 21 define a pair of "T" shaped members. Floatation members 20 and 21 are each preferably constructed of styrofoam, polyurethane foam or some other similar material having a high degree of structural integrity. Floatation members 20 and 21 may be secured to arms 15 and 16 by any suitable means, such as by epoxy cement, or by providing locking collars (not shown) to permit floatation members 20 and 21 to be removed and replaced at will.

Figure 4:
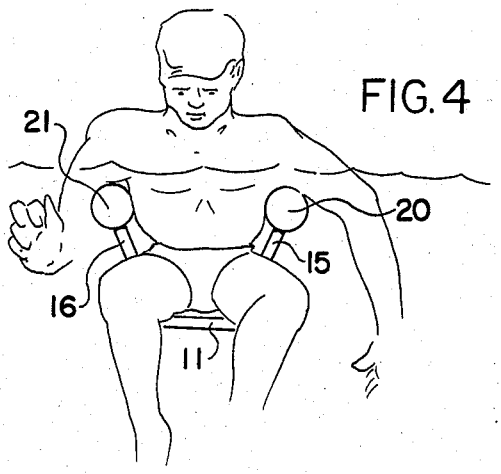
FIG. 4 is a front view of the floatation device shown in FIG. 2 when in use in the sidesaddle positions.

Several uses of floatation device 10 are shown in FIGS. 2, 3 and 4. Referring first to FIG. 2, floatation device 10 is shown being used by the user in an astride position. In this position, the seat 11 extends through the user's crotch from the front to the rear. Floatation member 20 extends upwardly into contact with the user's back and floatation member 21 extends upwardly into contact with the user's chest. Because floatation members 20 and 21 are independently movable, rearward or forward movement of the user will deflect the respective floatation member 20 or 21 without also deflecting seat 11 or the other floatation member. In consequence, tipping and disorientation of the user is very unlikely.

Floatation members 20 and 21 are substantially longer than either the width or thickness of the user's torso. Therefore, the floatation device 10 provides a very stable platform which provides vertical, side-to-side and front-to-back support to a user. Even if the user should tip forward, backward or to one side, the independent movement and substantial length of floatation members 20 and 21 will usually prevent the user from dismounting the floatation device 10. Also, because of the relatively long lever arm formed by floatation members 20 and 21, tipping occurs relatively slowly, which gives the user a chance to right himself or to grab hold of the floatation member 21.

FIG. 3 illustrates usage of the floatation device 10 in a reclining position. In the reclining position, the floatation member 20 supports the back as in the astride position shown in FIG. 2. However, the legs are placed over floatation member 21 with floatation member 21 resting against the back of the knee. This movement tends to spread the floatation members 20 and 21 apart. Again, the long length of the floatation members 20 and 21 provides very stable support for the user. Depending upon the size of the user's torso, floatation member 20 may be placed under the back of the neck rather than across the upper back, as is shown in FIG. 3.

Referring now to FIG. 4, floatation device 10 is shown with the user in a sidesaddle position. In this position, the floatation members 20 and 21 are positioned under the user's arms and primary stability is provided to the user in the front to back direction. Therefore, should the user tip to the front or back, the substantial length of floatation members 20 and 21 will arrest the user's rearward or forward motion, especially with the assistance of the arms in position over floatation members 20 and 21. Side-to-side support is also provided, since the independent movement of floatation members 20 and 21 prevents seat 11 and the other floatation member from moving in unison with the other floatation member, should it be pushed downwardly.

Figure 8:
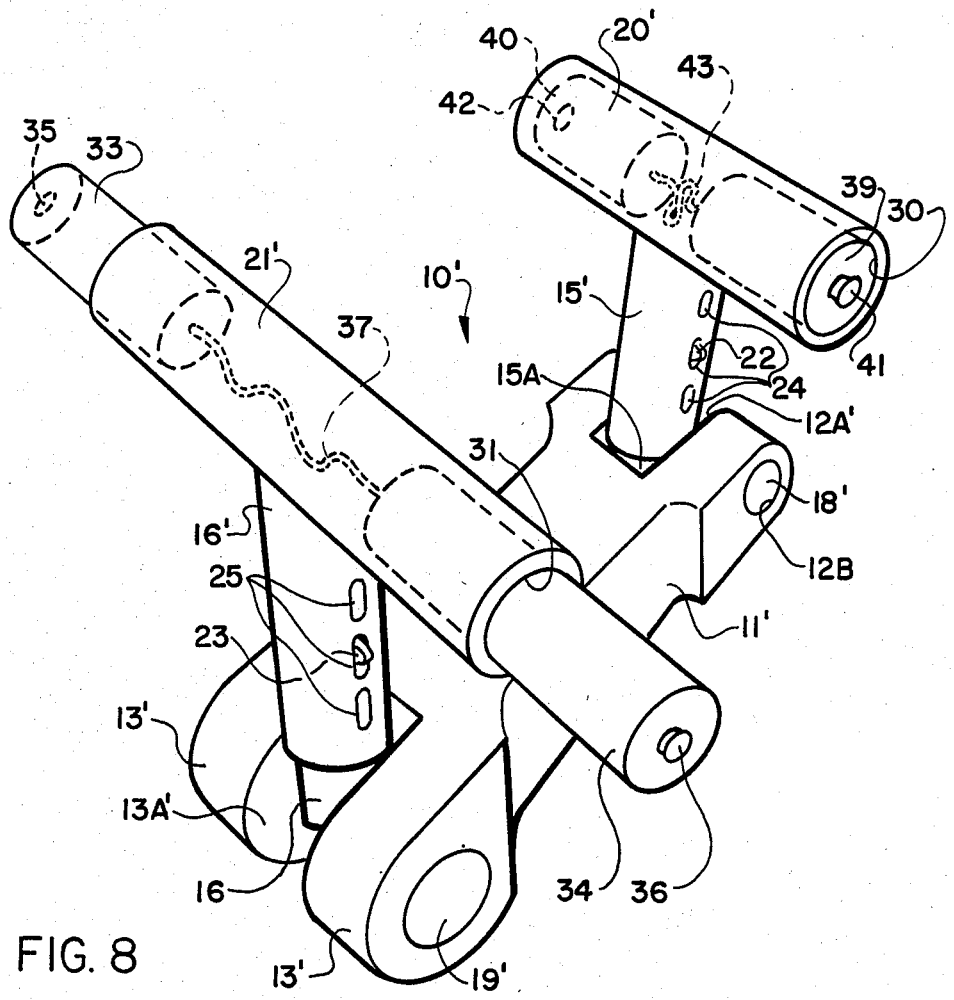
FIG. 8 is a floatation device of the type shown in FIG. 2 but showing means for upward adjustment of the floatation arms in order to position the floatation members in a pre-determined location relative to the torso of the user and also showing auxiliary stabilizing floats positioned within the first and second elongate body supports.

Referring now to FIG. 8, a floatation device 10' is shown, which, in addition to the features and elements illustrated in FIG. 1, also includes arm adjustment means and auxiliary stabilizing means.

In order to adjust the length of arms 15' and 16' to the particular user, the arms are made to telescope on arm supports 15*a* and 15*b*, respectively. Arm supports 15*a* and 16*a* include spring-loaded studs 22 and 23, respectively. Studs 22 and 23 are adapted to cooperate with one of a plurality of locking holes 24 and 25. By depressing the stud and moving arm 15' or 16' in the direction desired, the appropriate height can be achieved. When the stud is moved into registration with one of the holes 24 or 25, it springs outwardly, locking arm 15' or 16' in its proper position. In this embodiment, studs 24 and 25 also prevent the respective arms 15' and 16' from rotating out of their proper position at substantial right angles to the axis of seat 11'.

Also shown in FIG. 8 is an auxiliary stabilizing means, which comprises an axially extending bore 30 in floatation member 20' and an axially extending bore 31 in floatation member 21'. Bores 30 and 31 each communicate with opposite ends of their respective float members.

Referring now to float member 21', a pair of auxiliary floats 33 and 34 are positioned within opposite ends of bore 31. Auxiliary floats 33 and 34 are each formed of styrofoam, polyurethane foam or some other material having good structural integrity. Each auxiliary float 33 and 34 is adapted to be moved into or out of bore 31 as desired to increase the stability of floatation device 10' and 21' to tipping. Buttons 35 and 36 are secured to the outer ends of auxiliary floats 33 and 34, respectively, to assist movement of auxiliary floats 33 and 34 out of bore 31. If desired, the floats 33 and 34 may be secured together, such as by means of a flexible cord 37. This would prevent floats 33 and 34 from being separated, and in addition, would tend to prevent either of the floats from being extended completely beyond bore 31 during their adjustment.

Float member 20' likewise is provided with a bore 30 into which is positioned auxiliary floats 39 and 40. Auxiliary floats 39 and 40 are moveable by means of buttons 41 and 42, respectively, and are connected together by means of a flexible cord 43 in precisely the same manner as with auxiliary floats 33 and 34, described above.

Figure 6:
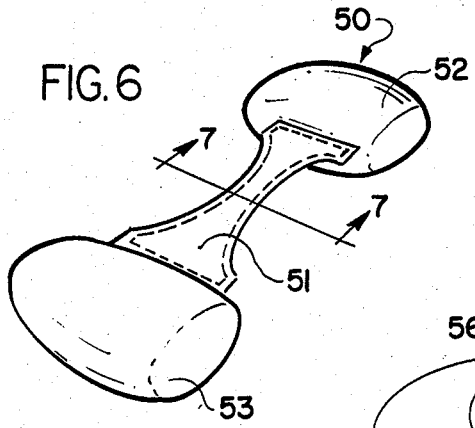
FIG. 6 is a perspective view of the floatation device shown in FIG. 5.

Referring now to FIG. 6, a floatation device according to another embodiment of the present invention is shown and broadly indicated at reference numeral 50. Floatation device 50 is formed of a seat 51 for supporting the user in a pre-determined position. The seat is hourglass-shaped having a narrow central portion adapted to pass between the legs of the user. Opposite ends of seat 51 are relatively wide and are designed to be affixed to a pair of floatation members 52 and 53. Floatation members 52 and 53 are preferably formed of a pair of bags or envelopes which are each filled with a lightweight, buoyant substance such as kapok, polyurethane or polyethylene foam. Floatation members 52 and 53 are each hinged to seat 51 by means of stitching so that they may extend upwardly on either side of a user in response to their buoyancy.

Figure 5:
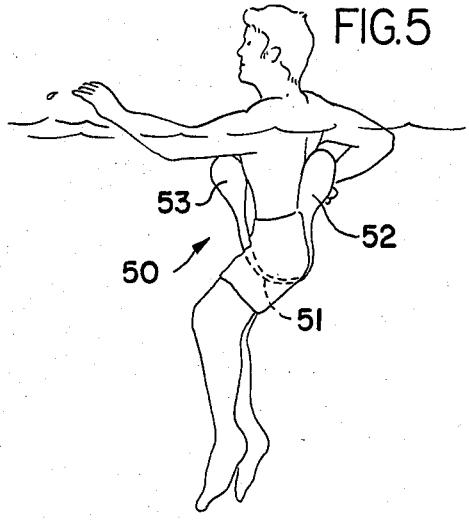
FIG. 5 is a side view of a floatation device according to another embodiment of the invention.

The floatation device in use is shown in FIG. 5; seat 51 passes between the legs of the user with floatation member 52 resting against and supporting the back of the user, and floatation member 53 resting against and supporting the abdomen and chest of the user. Since both floatation members 52 and 53 are independently moveable, forward or rearward movement of the user does not cause both of the floatation members to move in the direction of movement of the user. Therefore, the floatation device 50 is inherently stable and is very suitable for use by invalids or handicapped individuals.

Figure 7:
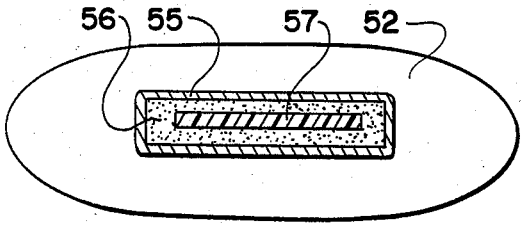
FIG. 7 is a cross sectional view of the seat portion of the floatation device shown in FIG. 6, taken substantially along lines 7—7 thereof.

The safety of the floatation device 50 is enhanced by means of a semiflexible, resilient plastic sheet which is sandwiched within seat 51. As is shown in FIG. 7, seat 51 in cross section is comprised of an outer fabric material 55 which completely encases floatation material, such as foam material 56. A plastic sheet material member 57 chosen for its semiflexible resilience and the ability to retain a plastic memory of a planar condition is positioned within the floatation material 56. The flexibility of member 57 is such that when the seat is mounted by the user and floatation members 52 and 53 move upwardly against the user's upper torso, member 57 flexes into a U-shaped member. However, should the user dismount or be tipped from the floatation device 10, the seat 51 will instantly move upwardly under the urging of floatation members 52 and 53 and member 57 will resume its planar shape. This prevents the floatation members 52 and 53 from wrapping around the leg or ankle of the user and perhaps pulling the foot upwardly. The upward movement of the foot might cause the upper portion of the body to be submerged in the water.

The embodiments disclosed above rely on buoyant solid materials for floatation. However, air inflation alone or a combination of air inflation and foam can be used. Foam products are considered the safest since inadvertent deflation is not possible.

Several embodiments of a floatation device are described above. Various details of the invention may be changed without departing from its scope. Furthermore, the foregoing description of several embodiments of the invention according to this application is provided for the purpose of illustration only and not for the purpose of limitation—the invention being defined by the claims.

I claim:

1. A float for providing vertical, side-to-side and front-to-back support to a user, such as handicapped or invalid users, and comprising:

(a) a seat for supporting the user in a pre-determined astride, sidesaddle or reclined position;

(b) first and second elongate arms secured, respectively, by one end thereof to opposite ends of said seat, said first and second arms extending outwardly therefrom and secured by hinges so as to be independently moveable about their respective hinges in response to movement of the user in the water to permit adjustment to varying body positions and movements of the user;

(c) first and second flotation members secured, respectively, to the free, outwardly extending ends of said first and second arms; one of said first and second flotation members adapted to support the front of the torso of the user in the astride position, one side of the torso in the sidesaddle position, or the legs in the reclined position, and the other of said first and second flotation members adapted to support the rear of the torso of the user in the astride and reclined positions, or the other side of the torso in the sidesaddle position, said first and second flotation members being attached, respectively, to said arms at substantially right angles thereto to collectively define a pair of "T" shaped members which provide stability in the water and permit free use of arms and legs by the user, said first and second elongate arms being pivotable from a first position wherein said free, outwardly extending ends of said arms are closest to each other to a position wherein said free outwardly extending ends of said arms are farther from each other and each of said arms forms an angle of substantially more than 90 degrees with the portion of said seat lying between said first and second arms.

2. A float according to claim 1, and including auxiliary stabilizing means carried by each of said first and second floatation members and selectively moveable between a retracted position and an extended position to provide greater leverage against side-to-side or front-to-back tipping.

3. A float according to claim 2, wherein said auxiliary stabilizing means comprises:

(a) said first and second floatation members each defining an axially extending bore therein communicating with opposite sides thereof; and, (b) an auxiliary float positioned for sliding movement within said bore between the retracted position wherein the auxiliary float is telescoped inside respective said floatation members and the extended position wherein one or both of said first and second auxiliary floats is extended to a variable degree through opposite ends of said bore to the outside of each said floatation member.

4. A float according to claim 3, wherein said axially extending bore in each of said floatation members communicates with opposite sides thereof and first and second auxiliary floats are positioned within said bore for sliding movement within the bore between the retracted position wherein both floats are telescoped within respective floatation members and the extended position wherein one or both of said first and second auxiliary floats is extended to a variable degree through opposite ends of said bore to the outside of said floatation members.

5. A float according to claim 1 wherein said first and second elongate arms includes means for adjusting their respective length in order to position said first and second floatation members in a desired, pre-determined location relative to the torso of the user and also on or beneath the surface of the water.

6. A float for providing vertical, side-to-side and front-to-back support to a user, such as handicapped or invalid users, and comprising:

(a) a seat for supporting the user in a predetermined astride, sidesaddle or reclined position;

(b) a first buoyant, elongate body support secured by a hinge to said seat adjacent one end thereof and adapted to support the front of the torso of the user in the astride position, one side of the torso in the sidesaddle position, or the legs in the reclined position;

(c) a second buoyant, elongated body support secured by a hinge to said seat adjacent the other end thereof and adapted to support the rear of the torso of the user in the astride and reclined positions, or the other side of the torso in the sidesaddle position; and (d) said first and second body supports freely and independently moveably about their respective hinges within a relatively wide angle of travel in response to movement of the user in the water to permit adjustment to varying body positions and movements while maintaining the user in the predetermined position on said seat and permitting free use of arms and legs by the user, said float including auxiliary stabilizing means carried on each of said first and second body supports and selectively moveable between a retracted position within said body supports, and an extended position outboard of said body supports to provide greater leverage against side-to-side or front-to-back tipping, said stabilizing means comprising said first and second elongated body supports each defining an axially extending bore therein with an opening therein and an auxiliary float positioned for sliding movement within each of said bores between the retracted position wherein one of the auxiliary floats is telescoped inside its respective body support and the extended position wherein said auxiliary float is extended to a variable degree through the opening to the outside of its respective body support, and further wherein each said axially extending bore communicates with opposite sides of its respective body support and first and second auxiliary floates are positioned within each of said bores for sliding movement within the bore between the retracted position wherein both first and second floats are telescoped within said body support and the extended position wherein one or both of said first and second auxiliary floats is extended to a variable degree through opposite ends of said bore to the outside of said body support.

* * * * *